United States Patent [19]

Bauer

[11] Patent Number: 4,459,948

[45] Date of Patent: Jul. 17, 1984

[54] GLOW PLUG FOR INTERNAL COMBUSTION ENGINES

[75] Inventor: Paul Bauer, Steinheim, Fed. Rep. of Germany

[73] Assignee: Beru-Werk Albert Ruprecht GmbH & Co., K.G., Ludwigsburg, Fed. Rep. of Germany

[21] Appl. No.: 313,319

[22] Filed: Oct. 20, 1981

[30] Foreign Application Priority Data

Oct. 30, 1980 [DE] Fed. Rep. of Germany ..... 3040906
Sep. 16, 1981 [DE] Fed. Rep. of Germany ..... 3136852

[51] Int. Cl.[3] ..... F02B 9/08; F02P 19/02

[52] U.S. Cl. ..... 123/145 A; 219/270; 361/266

[58] Field of Search ..... 123/145 R, 145 A; 219/267, 270; 361/264, 266

[56] References Cited

U.S. PATENT DOCUMENTS 3,407,794 10/1968 Nagai et al. ..... 123/145 A
3,566,850 3/1971 Beesch ..... 123/145 A

FOREIGN PATENT DOCUMENTS 1207147 12/1965 Fed. Rep. of Germany .
1931381 1/1966 Fed. Rep. of Germany .
2209339 11/1972 Fed. Rep. of Germany .
835636 5/1960 United Kingdom .

*Primary Examiner*—Parshotam S. Lall
*Assistant Examiner*—W. R. Wolfe
*Attorney, Agent, or Firm*—Fleit, Jacobson, Cohn & Price

[57] ABSTRACT

A glow plug for internal combustion engines, the plug including a plug barrel, an electric heater for igniting the fuel, and a device for the metered injection of liquid fuel into the glow plug. The plug includes a centrally positioned heating pin in a pasageway through which the metered fuel passes, the heating pin including a thickened portion to define a valve. A chamber is provided in the glow plug barrel and is heated by the electric heater for evaporating the injected liquid fuel. The barrel includes a tube around the heating pin tip to provide a mixing chamber that contains concentrically arranged bores that extend into the mixing chamber and are connected to an air supply line in the vicinity of the opposite end of the plug barrel to permit air and evaporated fuel to mix to give improved combustion.

20 Claims, 6 Drawing Figures

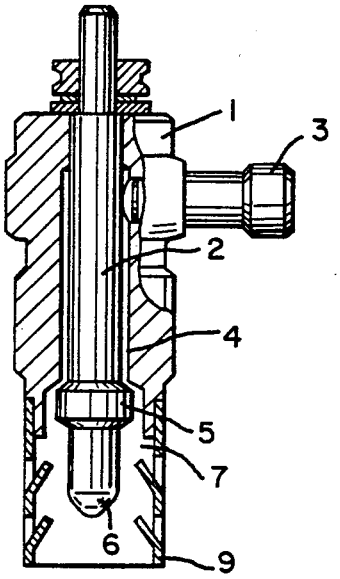
FIG. 1
FIG. 2
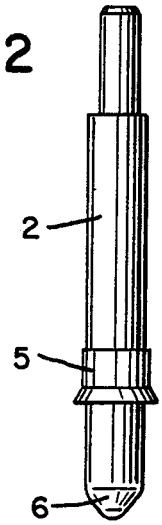
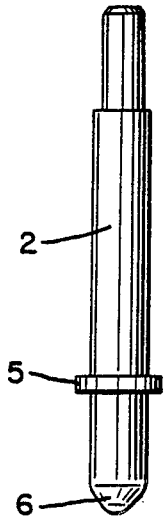
FIG. 3

FIG. 5
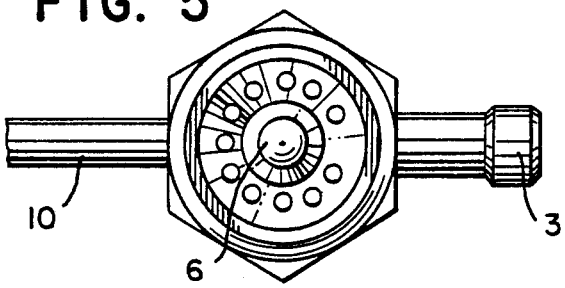
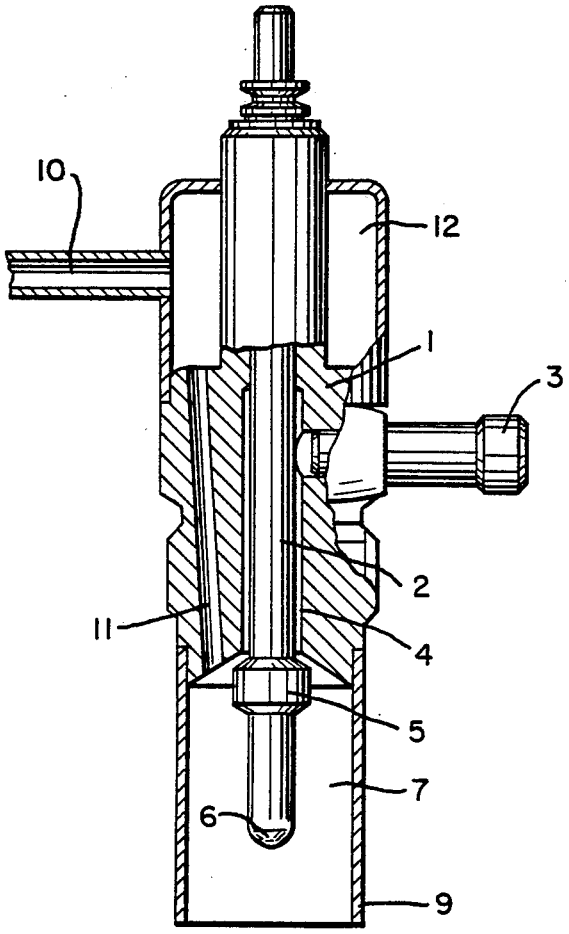
FIG. 4

GLOW PLUG FOR INTERNAL COMBUSTION ENGINES

BACKGROUND OF THE INVENTION

The present invention relates to a glow plug for internal combustion engines, particularly as a starting aid in diesel engines and which substantially comprises a glow plug barrel, at least one electric heater for igniting the injected fuel and an apparatus for the metered injection of liquid fuel. Glow plugs of this type are generally known. Disadvantages of the known glow plugs are their long preliminary heating time and pronounced drop formation due to inadequate preheating of the injected fuel. For the partial elimination of these disadvantages German Utility Model No. 19 31 381, for example, proposes evaporation of the fuel in a fuel jet heated from the outside. However, due to the considerable constructional expenditure and the only minor improvements to the above disadvantages this solution has acquired no practical significance.

BRIEF DESCRIPTION OF THE INVENTION

The problem of the present invention is to provide a glow plug which, due to its simple construction from only a few components, leads to fewer manufacturing problems and which can simultaneously be operated without drop formation, whilst considerably reducing the ignition time.

These problems are solved by the glow plug according to the present invention.

The glow plug according to the invention has a chamber for evaporating the injected liquid fuel which, instead of being heated by an external heating device, is heated by the electric heater of the glow plug. During the combustion chamber warmup time said chamber is closed by the glow plug heater, that extends towards the combustion chamber, until the temperature in the evaporation chamber is higher than the evaporation temperature of the metered-in liquid fuel, so that the latter is present in said chamber only in evaporated form. The evaporation chamber is connected to the adjacent combustion chamber by a passage provided with a valve, the opening of the valve being initiated in per se known manner at a given temperature above the evaporation temperature in the evaporation chamber.

Advantageously the valve is directly opened by a specific volume increase of the heater during the heating thereof. It is particularly advantageous if the heater is constituted by a per se known heating pin, whose temperature-dependent elongation above a given value activates the opening of the valve.

Advantageously in the vicinity of its tip the heating pin is provided with an optionally annular or conical thickened portion resting in gas-tight manner on the correspondingly constructed sides of the glow plug barrel in the vicinity of the passage from the evaporation chamber to the combustion chamber when the heating pin has not yet been heated to such an extent that the temperature in the evaporation chamber is above the evaporation temperature of the injected fuel. It is particularly advantageous if this sealing seat is constructed elastically or resiliently, so that an additional control of the opening time of this valve-like closure is possible.

According to a particularly preferred embodiment the glow plug according to the invention has an evaporating chamber extending concentrically about the central area of the heating pin and which has an annular cross-section and whose cylindrical outer wall and upper wall are formed by the plug barrel and whose inner wall is the heating pin surface. In the direction of the combustion chamber the evaporating chamber is sealed in gas-tight manner by the thickened portion in the vicinity of the heating pin tip.

A further improvement for overcoming the indicated disadvantages and therefore for reducing the starting time, accompanied by the simultaneous complete combustion of the evaporated hydrocarbons, comprises air being introduced into the spark plug barrel through bores or an annular clearance which, by means of the bores or a corresponding ring nozzle in the combustion chamber-side area of the plug barrel is introduced into the combustion chamber on to the plug tip.

The resulting improvement can be made even better by arranging a protective tube around the heating pin tip, so that around the latter a mixing chamber is formed in which evaporated fuel and supplied air can mix to give rapid and optimum combustion.

Due to its simple construction with only a few components the glow plug according to the invention can easily be manufactured. Additional heating elements are made superfluous by the heating of the evaporation chamber according to the invention. Its ignition time is less than 10 seconds, which is much less than that of hitherto known glow plugs. In addition, burning takes place in drop-free manner in the case of the stipulated fuel metering and operation can take place with or without a metering insert. Finally there is no interruption of the flame, even at high air speeds.

These surprising advantages, accompanied by the amazingly simple construction indicate the importance of the present invention.

BRIEF DESCRIPTION OF THE DRAWINGS

The invention is described in greater detail hereinafter relative to non-limitative embodiments and the attached drawings, wherein show:

FIG. 1 diagrammatically illustrates an embodiment for a glow plug according to the invention in cross-section.

FIG. 2 is a view of the heating pin of the glow plug according to the invention with a conical thickened portion in the vicinity of the pin tip.

FIG. 3 corresponds to FIG. 2, the thickened portion in the vicinity of the heating pin tip being annular.

FIG. 4 diagrammatically illustrates another embodiment for a glow plug according to the invention in cross-section and through whose barrel air can be passed into the vicinity of the heating pin tip.

FIG. 5 is a plan view of the glow plug of FIG. 4 after rotation by 90° towards the heating pin tip.

DETAILED DESCRIPTION OF THE PREFERRED EMBODIMENTS

Figure 6:
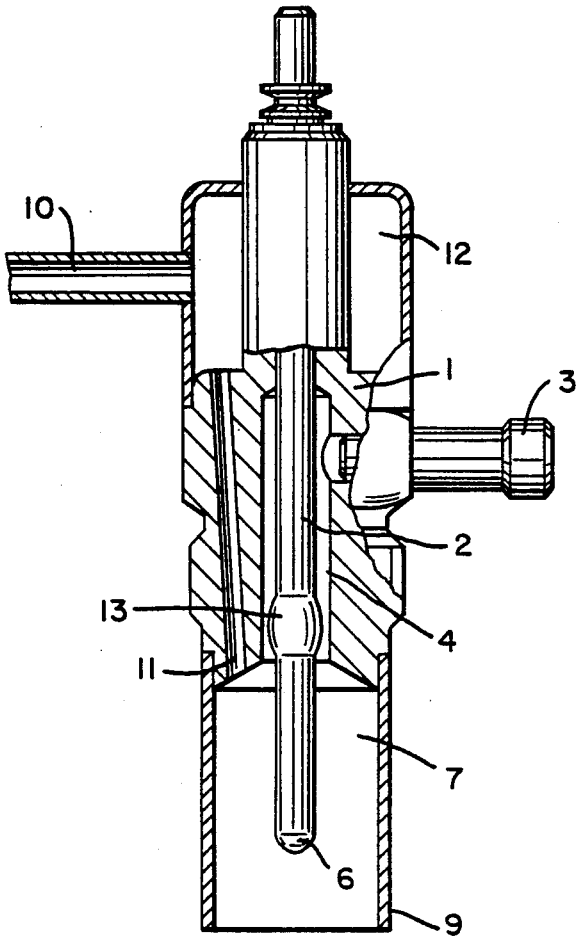
FIG. 6 diagrammatically illustrates a further modified embodiment corresponding to the glow plug of FIG. 4.

According to FIG. 1 the glow plug according to the invention comprises a plug barrel 1, a heating pin 2 and a not shown metering device 3 for the inflowing fuel. Evaporating chamber 4 comprises a cylindrical bore extending vertically through the barrel 1 and whose diameter is larger than that of the heating pin 2 located centrally therein. The evaporating chamber 4 extends approximately from the inlet port of metering device 3 up to the thickened portion 5 of heating pin 2 in the vicinity of pin tip 6 projecting into combustion chamber 7. The thickened portion 5 extends outwardly from the plug axis and beyond the outer edge of evaporating chamber 4 to cooperate therewith to define a valve means. When the heating pin 2 is in the cooled state the sides of the thickened portion 5 facing evaporating chamber 4 engage in gas-tight manner on the correspondingly shaped, opposite inner sides of the plug barrel 1 and close the passage from evaporating chamber 4 into combustion chamber 7. Thickened portion 5, which is an integral part of heating pin 2, or can be welded, soldered or pressed on to the latter, can be constructed elastically or resiliently in the longitudinal direction of pin 2. Advantageously a protective tube 9 is arranged around the heating pin tip 6 and which is fixed to the lower end of plug barrel 1.

FIG. 2 is a view of a modified heating pin 2 according to the invention with a collar-like thickened portion 5 fixed in sleeve-like manner to heating pin 2 above heating pin tip 6.

In FIG. 3 thickened portion 5 is annular with a planar sealing area above the heating pin tip 6 on pin 2.

Obviously in the different variants of thickened portion 5 the facing bearing or contact surface of barrel 1 is correspondingly constructed for the gas-tight closing of evaporating chamber 4.

The embodiment of FIG. 4 essentially corresponds to that of FIG. 1 with the difference that devices are provided for supplying air into the combustion chamber area 7 formed around the heating pin tip 6. They are constituted by a ring duct 12 in the upper area of the spark plug which, for air supply purposes is provided pipe connection 10. A plurality of bores 11 extend longitudinally through the plug barrel 1 from ring duct 12 and pass out of the barrel in the vicinity of the opening of evaporating chamber 4 towards combustion chamber 7. These bores 11 are preferably so inclined with respect to the longitudinal axis of the plug that their imaginary extension meets the heating pin tip 6 so that the supplied air is directly passed to the ignition point. Only in the vicinity of the passage of metering device 3 through the plug barrel is no such bore 11 provided.

Optionally the bores can be constructed in the form of an annular clearance, the discharge port towards the combustion chamber preferably being in the form of a ring nozzle. Otherwise the components and reference numerals are the same as in the other drawings which have already been described.

FIG. 5 is a plan view of the heating pin tip 6 and shows the pipe connection 10 for feeding in air, the metering device 3 and the discharge ports of bores 11.

With regards to the reference numerals and components the embodiment of FIG. 6 corresponds to that of FIG. 4. An essential difference is that according to the present embodiment the heating pin 2 is not constructed as a valve and is instead a straight through heating pin, which is otherwise arranged in the above-described manner in evaporating chamber 4. It can optionally have a thickened portion 13, which brings about a certain damming back action with regards to the supplied fuel and a turbulent action which is advantageous for igniting the gaseous fuel.

The heating pin 2 is provided with an internal heating coil made from a material such as nickel wire having a positive temperature coefficient, that can be a low temperature coefficient. Alternatively, the heating pin can be provided with internal, series-connected heating coils having widely differing temperature coefficients.

It is common to all the embodiments of the invention that the ratio of the diameter of evaporating chamber 4 to that of heating pin 2 is approximately 1.1 : 1. In the case of conventional dimensioning of the glow plug, annular clearance widths of approximately 0.2 to 2 mm, preferably 0.4 to 1.8 mm and particularly approximately 0.5 to 1 mm are very suitable.

What is claimed is:

1. A glow plug for internal combustion engines, particularly as a starting aid for diesel engines, said plug comprising: a plug barrel, at least one electric heater for igniting the fuel, and a device for the metered injection of liquid fuel into the glow plug, wherein a chamber heated by the electric heater is provided for evaporating the injected liquid fuel and wherein the flow plug barrel contains concentrically arranged bores, which pass out of the plug barrel on the combustion chamber side area of the plug and are connected to an air supply line in the vicinity of the opposite plug barrel end.

2. A glow plug according to claim 1, wherein the bores are widened to form an annular clearance arranged in the plug barrel substantially concentrically to the longitudinal axis of the barrel.

3. A glow plug according to claim 2, wherein the discharge port of the concentric annular clearance is constructed in the form of a ring nozzle.

4. A glow plug according to claim 3, wherein a protective tube is arranged around the heating pin tip.

5. A glow plug according to claim 4, wherein the heating pin is provided with internal, series-connected heating coils having widely differing temperature coefficients.

6. A glow plug according to claim 5, wherein the heating pin is provided with an internal heating coil made from a material with a low temperature coefficient.

7. A glow plug for internal combustion engines, particularly as a starting aid for diesel engines, said plug comprising: a plug barrel, at least one electric heater for igniting the fuel and a device for the metered injection of liquid fuel into the glow plug, wherein a chamber heated by the electric heater is provided for evaporating the injected liquid fuel and wherein the heated chamber for evaporating the injected liquid fuel is separated from the combustion chamber and is connected to the latter by a valve, which is opened when the temperature in the evaporating chamber is above the evaporation temperature of the fuel.

8. A glow plug according to claim 7, wherein the opening of the valve is initiated by a specific volume expansion of the heater.

9. A glow plug according to claim 8, wherein the electric heater includes a heating pin.

10. A glow plug according to claim 9, wherein said pin has a clearly defined thermal elongation which controls the opening of the valve.

11. A glow plug according to claim 10, wherein the heating pin in the vicinity of the heating pin tip in the unheated state separates the evaporating chamber from the combustion chamber.

12. A glow plug according to claim 11, wherein the heating pin has a thickened portion in the vicinity of its tip which, in the unheated state, overlaps in a gas-tight sealing manner the outlet from the evaporating chamber to the combustion chamber.

13. A glow plug according to claim 12, wherein an evaporating chamber is provided within the plug barrel and extends concentrically around the heating pin and over approximately half its length, the outlet of said evaporating chamber towards the combustion chamber is sealable in valve-like manner by a concentric thickened portion of the heating pin in the vicinity of the pin tip.

14. A glow plug according to claim 13, wherein the thickened portion is elastic in the vicinity of the heating pin tip.

15. A glow plug according to claim 14, wherein the thickened portion is constructed as a ring secured to the heating pin and defines a sealing seat.

16. A glow plug according to claim 15, wherein a protective tube is arranged around the heating pin tip.

17. A glow plug according to claim 16, wherein the heating pin is provided with internal, series-connected heating coils having widely differing temperature coefficients.

18. A glow plug according to claim 17, wherein the heating pin is provided with an internal heating coil made from a material such as nickel wire having a positive temperature coefficient.

19. A glow plug according to claim 18, wherein the heating pin is provided with an internal heating coil made from a material with a low temperature coefficient.

20. A glow plug according to claim 18, wherein the heating pin is provided with an internal heating coil made from a material with a low temperature coefficient.

* * * * *